United States Patent [19]

Ohmori

[11] 4,190,188

[45] Feb. 26, 1980

[54] CONTAINER AND CONE FOR SAME

[75] Inventor: Koichiro Ohmori, Tokyo, Japan

[73] Assignee: Honshuseishi Kabushiki Kaisha, Japan

[21] Appl. No.: 903,065

[22] Filed: May 5, 1978

[51] Int. Cl.[2] ..... B65D 13/04; B65D 41/48; B65D 41/44

[52] U.S. Cl. ..... 229/5.6; 229/4.5; 215/326

[58] Field of Search ..... 229/4.5, 5.6, 5.7; 215/326

[56] References Cited

U.S. PATENT DOCUMENTS

| | | | |
|---|---|---|---|
| 1,150,823 | 8/1915 | Janisch | 215/326 X |
| 1,196,830 | 9/1916 | Wright | 229/5.6 |
| 1,217,599 | 2/1917 | Hill | 229/4.5 |
| 1,265,507 | 5/1918 | Perrault | 229/4.5 X |
| 2,015,426 | 9/1935 | Gough | 215/326 X |
| 2,293,142 | 8/1942 | Johnson | 229/4.5 X |
| 2,409,655 | 10/1946 | Annen | 229/5.6 |
| 2,467,016 | 4/1949 | Dunlap | 229/5.6 X |
| 2,607,503 | 8/1952 | Sonnenberg | 215/326 X |
| 3,182,882 | 5/1965 | Aellen, Jr. et al. | 229/4.5 |

FOREIGN PATENT DOCUMENTS

| | | | |
|---|---|---|---|
| 757517 | 10/1933 | France | 229/4.5 |

*Primary Examiner*—Davis T. Moorhead
*Attorney, Agent, or Firm*—William E. Jackson

[57] ABSTRACT

A container includes a hollow truncated body made of paper material. The container body is tapered off so that the bottom end opening of the body is larger in size than the top end opening thereof. The top end of the body has an edge portion which is widened outwardly to a predetermined degree. The cover is bonded to the inner face of the widened edge portion of the body. The cover is sealed to the upper edge of the body after some desired liquid or powder is put into the container body.

16 Claims, 21 Drawing Figures

CONTAINER AND CONE FOR SAME

BACKGROUND OF THE INVENTION

The present invention relates to a sealed container for containing therein a liquid such as lactic acid beverage, milk, or powder or others.

Various types of container structures have been developed for containing lactic acid beverage, milk, juice, oil or others. Many efforts are made to prevent leakage through a region where an end closure member is sealed to a container body. One such effort is that a bottom open end of the container body is closed by an end closure member by depressing the end closure member into the bottom open end of the container body with a peripheral portion of the end closure member engaged by the marginal edge of the container body, as disclosed in my copending U.S. application, Ser. No. 678,107, entitled "LIQUID CONTAINER SEALING CONSTRUCTION AND METHOD AND APPARATUS FOR PRODUCING THE SAME", filed Apr. 19, 1976, now abandoned.

With regard to the top end of the container, the top enclosure is sealed to the body after the liquid or other material is poured into the container. This differs from the sealing of the bottom end of the container body and makes it difficult to seal completely the container body with the enclosure.

In case of "cover-bonding" type of containers, a top enclosure or cover is bonded to the edge of the container body. For such a reason, the edge of the body is usually so thick that the cover can be easily bonded to the thick edge thereof without any deforming of the top end of the container body. However, it is difficult to produce the "cover-bonding" type of container bodies made of paper material because the thick edges of the container bodies can not easily be formed. This is a reason why most of known containers of such a type are made of plastic materials.

SUMMARY OF THE INVENTION

It is therefore an object of the present invention to provide a sealed container including a body which is made of paper material.

It is another object of the present invention to provide a sealed container comprising a hollow truncated body the top end of which is sealed by a cover.

It is a still another object of the present invention to provide a method for producing a sealed container including a body made of paper material.

It is a still another object of the present invention to provide a method for making a sealed container including a hollow truncated body the top end of which is sealed by a cover after a liquid or others is put into the body.

According to a preferred mode of the present invention, there is provided a container including a body made of paper material having air and/or liquid tightness. Such paper material can be produced, for example, by laminating heat sealable thermoplastic material such as polyethylene or polypropylene on a paper, or by coating heat-sensitive or pressure-sensitive adhesives on a paper or other sheet. The cover is preferably made of sheet material, for example, as is produced by laminating thermoplastic material such as polyethylene on an aluminum foil, or by coating hot melt on a paper or others. The container body is a hollow truncated body such as a truncated cone or a truncated pyramid, and the top end opening of the body is smaller in size than the bottom end opening thereof. The upper edge of the body is widened outwardly to some extent and the inner face of such widened portion is bonded to an annular portion of the cover so as to form a free edge thereof. Such a free edge can be later cut off.

According to another mode of the present invention, there is also provided a method for producing a sealed container including a container body made of paper material as above-mentioned. A cover is bonded to the upper edge of the body after a desired liquid or others is put into the body. The cover is bonded to the inner face of the outwardly widened or extended portion of the upper edge of the container body after or simultaneously when the upper edge of the body is widened outwardly. At that time, preferably, the peripheral edge of the cover is pressed down by any suitable means, for example, such as a combination of a ring and a die.

Other objects, features and advantages of the present invention will be apparent from the following description taken in connection with the accompanying drawings:

DETAILED DESCRIPTION OF THE PREFERRED EMBODIMENTS

Figure 1:
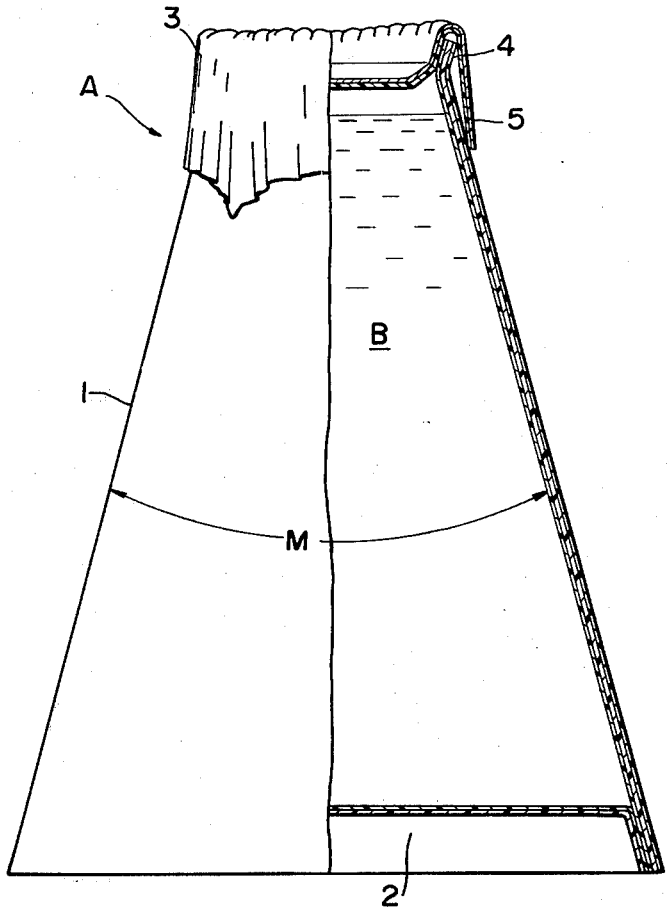
FIG. 1 is a partial section view of a sealed container according to a preferred embodiment of the present invention in which a liquid is contained.

Referring to FIG. 1, a sealed container generally designated at A is provided according to a preferred embodiment of the present invention. The container A comprises a body 1, a bottom closure member or base 2 and a top closure member or cover 3. The container A contains therein, for example, liquid B such as milk, juice, oil, liquor, cleanser, lactic acid beverage or the like. The base 2 is bonded to the lower end of the container body 1. Alternatively, the body 1 and the base 2 may be formed initially as one body. In such a case, it is not necessary to bond the base to the lower end of the body 1. The cover 3 is bonded to the upper end of the container body 1.

The container body 1 is made of paper material. The edge of the body 1 is widened outwardly so as to form a flange-shaped portion 4. Such paper material can be produced, for example, by laminating heat sealable thermoplastic material such as polyethylene or polypropylene on one or both sides of a paper, or by coating heat-sensitive or pressure-sensitive adhesives on a paper. Some examples of such sheet material are detailed in my copending U.S. patent application, Ser. No. 678,107, filed Apr. 19, 1976, entitled "LIQUID CONTAINER SEALING CONSTRUCTION AND METHOD AND APPARATUS FOR PRODUCING THE SAME", which disclosure is hereby incorporated by reference. In the embodiment as shown in FIG. 1, the paper material of the container body 1 is made by laminating polyethylene on both sides of a paper for obtaining the best results.

The base 2 is made of such sheet material as can be bonded to the bottom end of the body 1 so as to close the bottom end opening of the body 1. Some examples of such sheet material for the base 2 are disclosed in my copending U.S. patent application, Ser. No. 678,107 as above-mentioned. It is self-evident that no base member is necessary if the bottom of the container body is initially closed.

The cover 3 is formed of a sheet material as can be bonded to the inner face of the upper end of the body 1. Such sheet material can be made, for example, by laminating or coating polyethylene on at least one surface of an aluminum foil, a polyester sheet or paper. The cover 3 is preferably formed of a disk-shaped sheet. Alternatively, the cover may be of square, rectangle or the like. A polyethylene coating may be provided on the whole or an annular portion of one surface of the aluminum foil. In an embodiment as shown in FIG. 1, the cover 1 is formed of an aluminum foil coated wholly on its one surface with polyethylene. According to another embodiment of the present invention, the cover 1 may be formed of an aluminum foil or the like coated on its one surface with heat-sensitive, pressure-sensitive material, or hot melt.

The container body 1 is preferably formed of a hollow truncated shape such as a truncated cone or a truncated pyramid. FIG. 1 shows a hollow truncated cone as a preferred example of the body 1. The top opening of the body 1 is necessarily smaller in size than the bottom opening thereof. In other words, the container body 1 is tapered off and inclines to one another at an angle M preferably between about 5° and 40°, and for the best results 10° and 30° inwardly. The upper edge of the body 1 is widened so as to extend outwardly of the body to some extent thereby to form the flange-shaped portion 4. The inner face of the flange-shaped portion 4 of the body is bonded to an annular portion of the cover 3 where polyethylene is coated on the aluminum foil of the cover. In an embodiment as shown in FIG. 1, the marginal edge of the cover 3 extends beyond the end of the body 1 so as to form a peripheral free edge 5 which in turn is turned down over the top edge 4 of the body 1 along with the outer surface of the body 1. The free edge 5 of the cover may be used to open the cover 3 from the body 1 by pulling it. This type of container is called an easy-open type of container.

A method of joining the base 2 and the cover 3 to the container body 1 will be described.

First, the bottom end of the container body 1 is sealed with the base 2. For example, with regard to a method of pressure sealing, adhesives such as pressure-sensitive adhesives is coated on the inner surface of the peripheral edge of the base and/or the peripheral edge of the body 1. The container body 1 is held in position on a stationary holder. The base is arranged with its coated surface directed toward the open end of the container body 1. Then, the base 2 is pressure-sealed by means of a sealing head to the marginal edge of the container body 1. Alternatively, in regard to a method of heat sealing, heat-sensitive adhesives is coated on the marginal edge of the base 2 and/or the inner surface of the lower edge of the container body 1. Otherwise, heat-sensitive plastic film may be laminated on the inner surface of the lower edge of the body 1 and/or the marginal edge of the base 2. Also, both of the body and the base may be made of heat-sensitive plastic material. In such cases, the sealing head should be heated by any suitable heating means. Some methods of sealing the bottom end of the container body with the base are detailed in my copending U.S. application as above-mentioned, which disclosure is incorporated by reference.

Next, a desired liquid, powder or others is put into the container body 1 which is sealed at its bottom end with the base 2, to a predetermined level. Thereafter, the cover 3 is sealed to the upper end of the body 1, for example, by applying pressure and/or heat to a region where the cover 3 is in contact with the top end of the body 1. Before or simultaneously when the cover 3 is sealed to the body, the upper edge of the body 1 is widened outwardly so as to form a flange-shaped edge 4. Preferably, the upper edge of the body 1 is slightly widened before the liquid is poured into the body 1, as later described.

Figure 5:
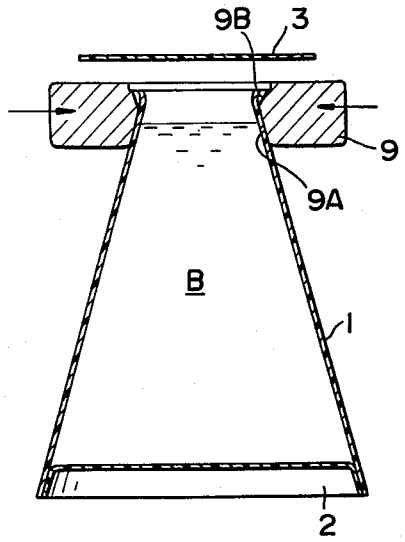
FIG. 5 shows a condition in which the container body is held in position in a die and a cover is set over the top opening of the container body.

With regard to a pressure-sealing method, pressure-sensitive adhesives is in advance coated on the inner surface of the container body 1 and/or an annular portion of the cover 3 preferably made of an aluminum foil. After the liquid B is poured into the body to a predetermined level, the body 1 is held in position in a die 9 (FIG. 5). A sealing head 8 depresses the cover 3 into the top opening of the body 1 with the annular portion of the cover 3 engaged by the top edge of the body supported by the die and especially a reverse-tapered portion. Then, the inner surface of the top edge of the body 1 and the annular portion of the cover 3 are pressed to each other between and by the sealing head and the reverse-tapered wall of the die. As a result, the cover is bonded to the inner surface of the top edge of the body. The top edge of the body is widened so as to form a flange-like periphery. The cover has a free edge which extends beyond the top end of the body 1.

Alternatively, in regard to a heat-sensitive method, heat-sensitive adhesives is in advance coated on the inner surface of the container body 1 and/or an annular portion of the cover 3. Otherwise, thermoplastic material may be laminated on the inner surface of the container body and/or the annular portion of the cover 3. When the cover is pressed between the die and the sealing head, the sealing head is heated at a predetermined temperature enough to melt the heat-sensitive adhesives.

A preferred mode of sealing the cover 3 with the container body 1 will be described with reference to FIGS. 2 to 15.

Figure 2:
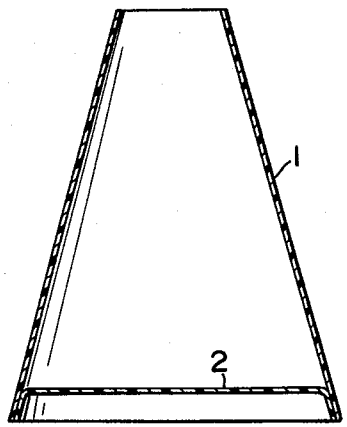
FIG. 2 illustrates a container body with its bottom end being sealed with a base according to an embodiment of the present invention.

FIG. 2 illustrates by way of example a container body 1 with its bottom end being sealed with a base 2. The body 1 is a hollow truncated cone. The body is tapered. The base 2 is of a disk-shape.

Figure 3:
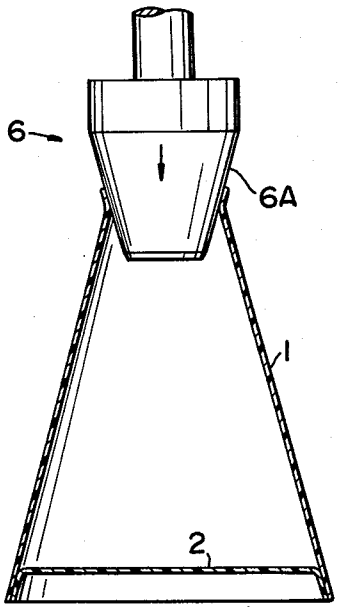
FIG. 3 shows a step during which the upper edge of the container body is slightly widened.

FIG. 3 shows a step in which the upper edge of the body 1 is slightly widened by moving a preliminary sealing head 6 into the top opening of the container body 1. A tapered portion 6A of the preliminary head 6 is preferably designed to be relatively small in angle and long in length. If the body 1 is only slightly tapered, then this step may be omitted.

Figure 4:
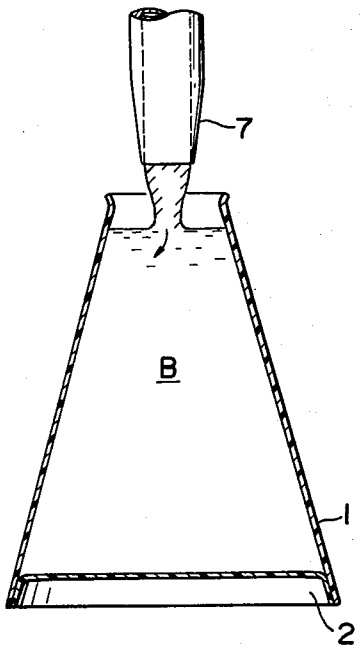
FIG. 4 illustrates the next step in which a desired liquid is poured into the container body.

FIG. 4 indicates the next step during which a desired liquid B is poured through a nozzle 7 into the body 1 to a predetermined level. The nozzle 7 is connected through pipe means to liquid feeding means (not shown) in a conventional manner.

At a step as shown in FIG. 5, the body 1 is held in position in the die 9. The die 9 is comprised of two halves which are designed to selectively combine or separate from each other. The halves of the die form, when combined, a hole for retaining the upper portion of the body 1. The die has a tapered wall 9A at its lower portion and a reverse-tapered wall 9B at its upper portion adjacent thereto (see also FIG. 10). The tapered portion 9A of the die 9 retains thereon the outer surface of the body 1. When the container body 1 is held in position in the die 9, a space is formed between the outer surface of the upper edge of the body 1 and the reverse-tapered portion 9B of the die. A disk-like base 3 is set over the top opening of the container body 1.

Figure 6:
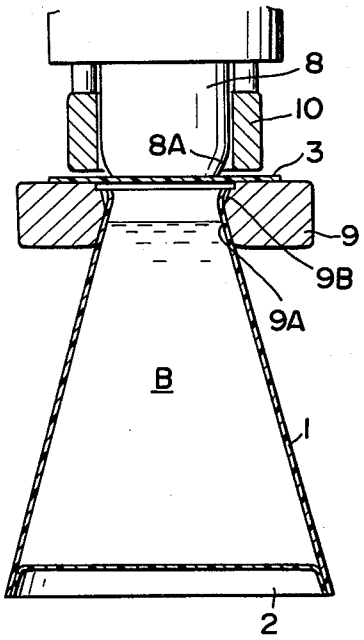
FIG. 6 indicates a step at which the cover is depressed by a sealing head, but the cover is not yet engaged with a ring.

FIG. 6 indicates a step during which a sealing head 8 depresses the cover 3 to some minor degree. The lower portion of the head 8 has a taper 8A corresponding to the reverse-tapered wall 9B of the die 9. Provided around the head 8 is a ring 10 for holding the marginal edge of the cover 3 between the ring 10 and the die 9 when the head 8 depresses the cover 3 into the top opening of the container body 1. Details of the ring 10 will be later described.

Figure 7:
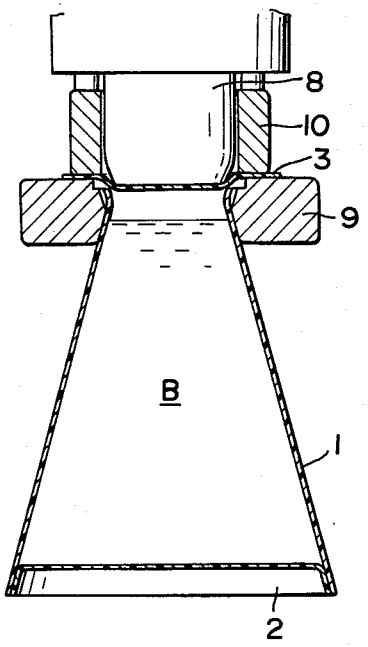
FIG. 7 illustrates the next step at which the cover is further depressed by the head and engaged with the ring.

At a step as shown in FIG. 7, the marginal periphery of the cover 3 is held between the ring 10 and the die 9, and then the head 8 depresses the cover 3 into the top opening of the container body 1.

Figure 8:
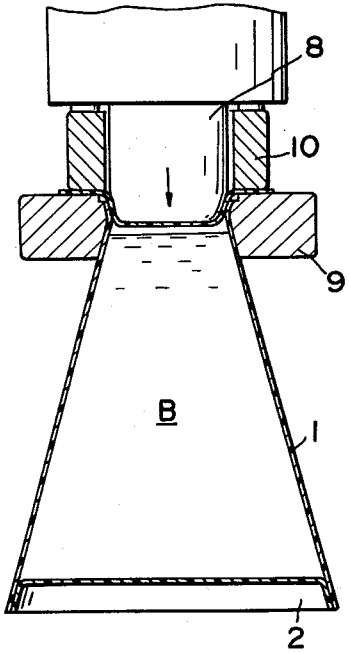
FIG. 8 illustrates a condition in which the cover is completely depressed into the body and the marginal edge of the cover is held under pressure between the ring and the die.

FIG. 8 shows a condition in which the cover 3 is further depressed into the opening of the body 1. The annular portion of the cover 3 is engaged with the inner surface of the upper edge of the body 1 which edge is supported by the die 9. The edge of the body and the cover 3 are pressed to each other between the reverse-tapered wall 9B and the taper 8A of the sealing head 8. As a result, the cover 3 is bonded to the inner surface of the upper edge of the body 1. At the same time, the upper edge of the body 1 is widened outwardly along the reverse-tapered wall 9B.

Figure 10:
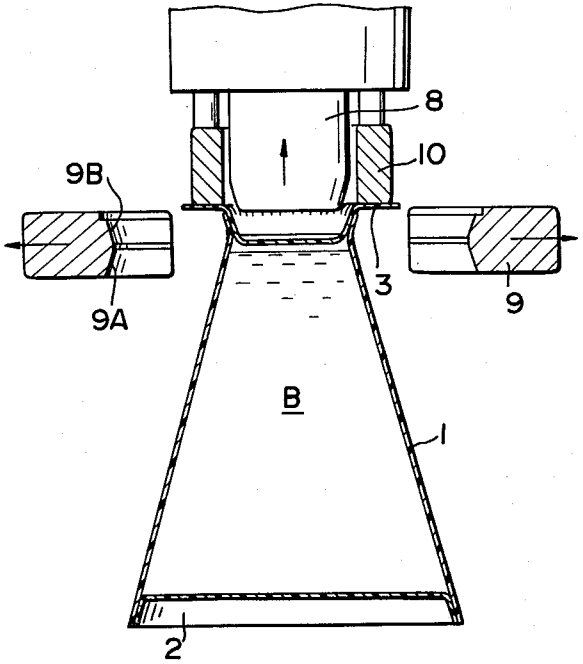
FIG. 10 shows that the head retracts upwardly away from its lower position.
Figure 9:
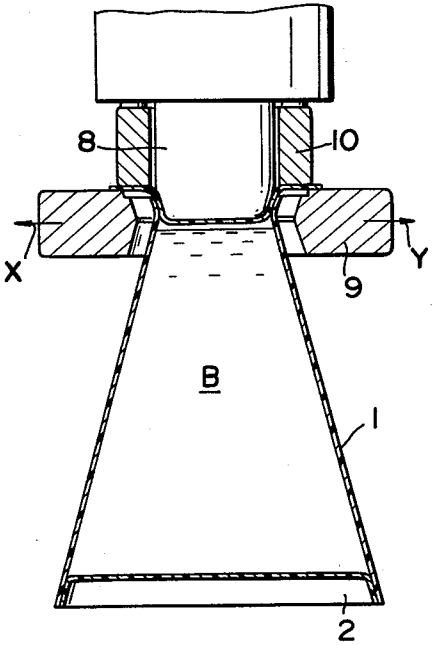
FIG. 9 indicates that two halves of the die are separating from each other.

FIG. 9 indicates that two halves of the die 9 are separating from each other in a direction of arrows X and Y, respectively. Next, the head 8 retracts upwardly away from its lower position, but the bottom surface of the ring 10 is still engaged with the flange-like free edge of the cover 3, as shown in FIG. 10.

Figure 11:
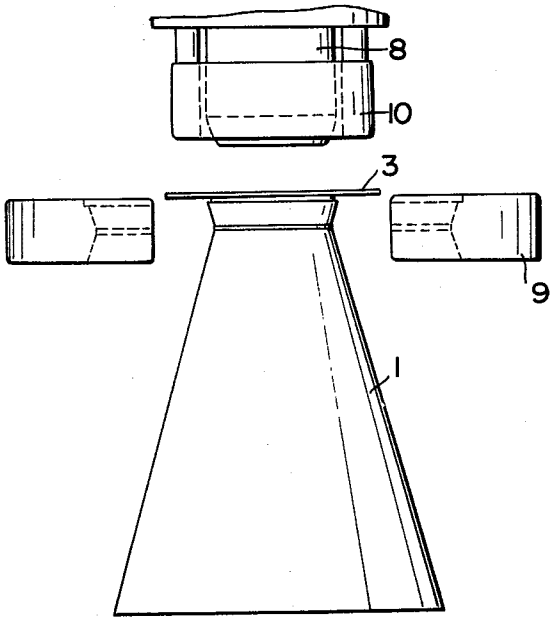
FIG. 11 indicates a condition in which the sealing is completed.

At a step as shown in FIG. 11, sealing of the cover with the body is completed, and the head 10 and the halves of the die 9 have come back to an original position. Thereafter, the sealed container is conveyed to a next step.

Figure 12:
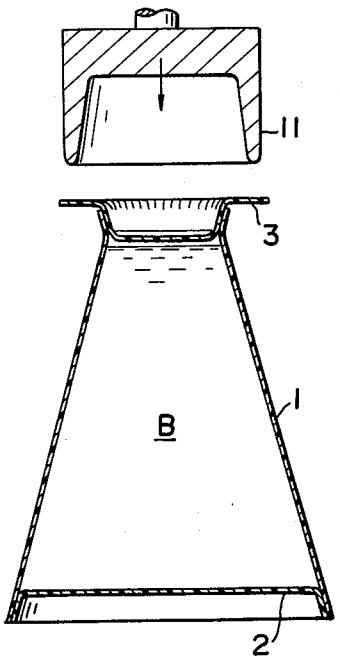
FIG. 12 illustrates the next step during which the periphery of the cover is depressed by a skirt-like member.

FIG. 12 illustrates the next step where a skirt-like member 11 depresses the marginal periphery of the cover 3.

Figure 13:
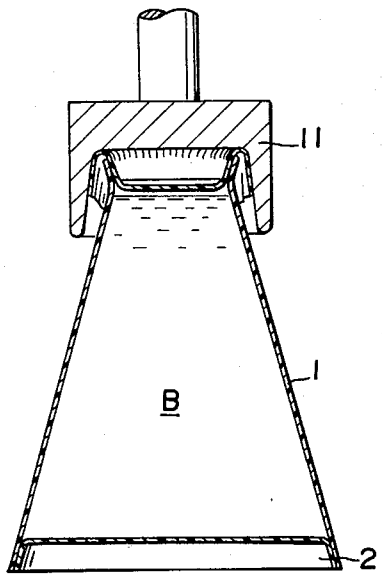
FIG. 13 shows that the skirt-like member has completely depressed the free edge of the cover.

FIG. 13 shows that the skirt-like member 11 has completely depressed the free edge of the cover 3. Thereafter, the pressing member 11 retracts upwardly to an original upper position. As a result, a sealed container as shown in FIG. 1 is produced.

Figure 14:
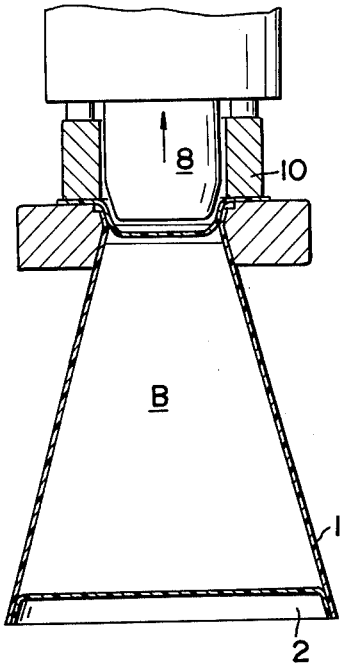
FIGS. 14 and 15 are views illustrating a modification of a method for sealing the container body with the cover.
Figure 15:
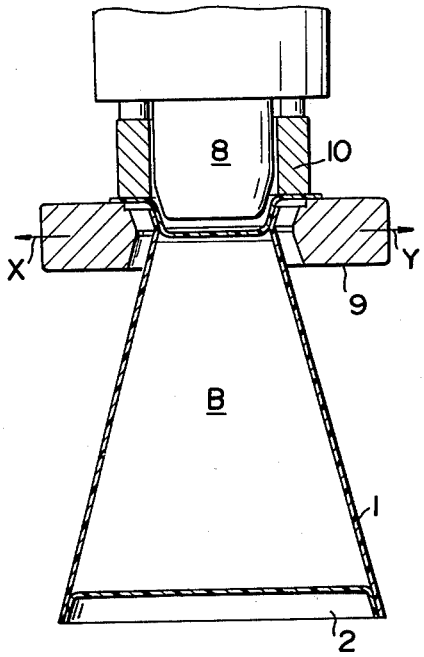

FIGS. 14 and 15 illustrate a modification of a method of sealing the cover with the container body. After the cover 3 is completely depressed by the sealing head 8 (see FIG. 8), the head 8 begins to retract upwardly as shown in FIG. 14, and then the halves of the die 9 begin to separate from each other in a direction of arrows X and Y (FIG. 15) while the bottom of the ring 10 is engaged with the free edge of the cover 3.

Figure 16:
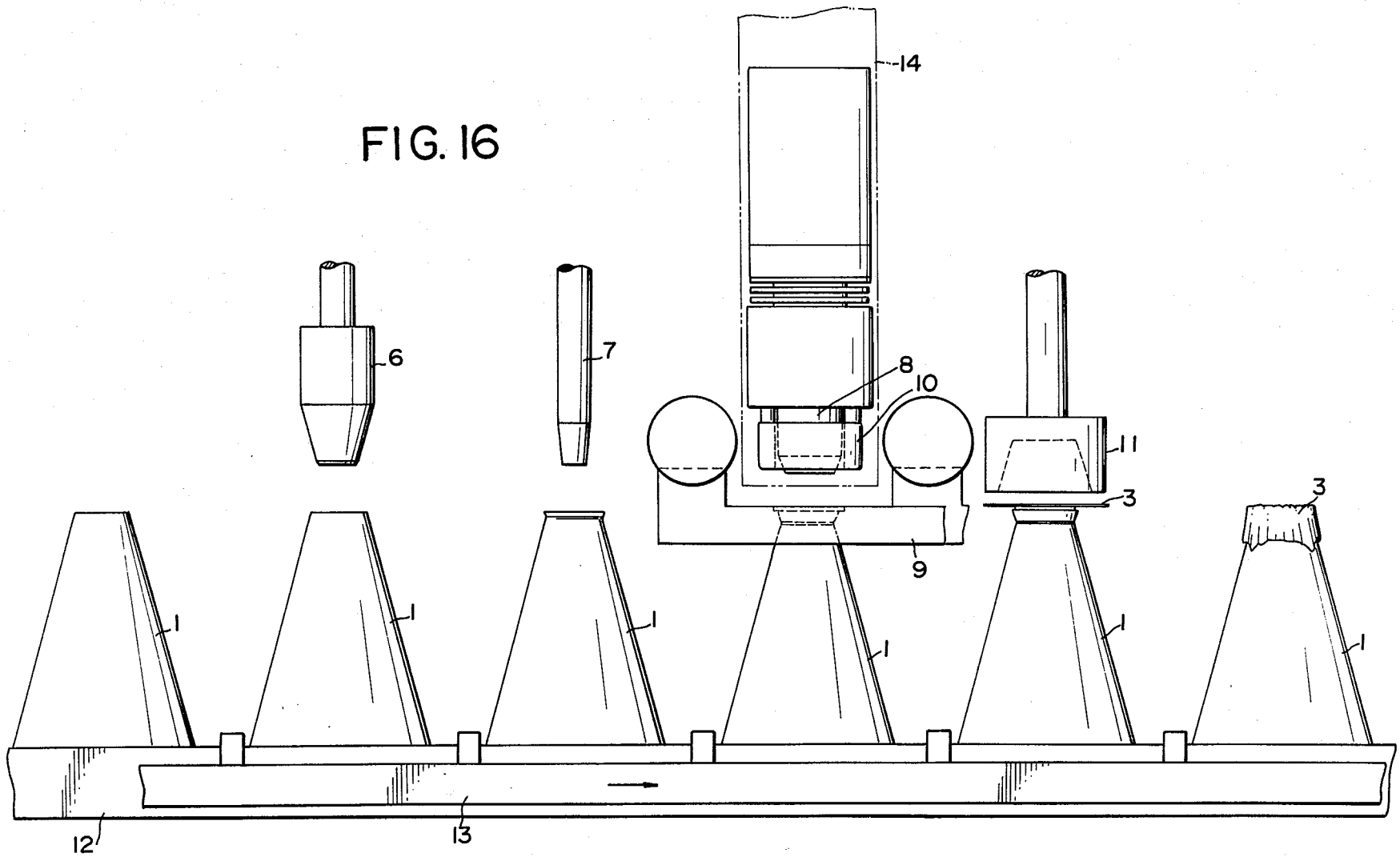
FIG. 16 is a schematic front view illustrating an apparatus for sealing a container with a cover.

FIG. 16 illustrates by way of example an apparatus for sealing a container with a cover. A series of container bodies 1 are conveyed in a direction of arrow Z on rails 12 by the intermittent movement of a centipede type of conveyer 13. The preliminary sealing head 6, the nozzle 7, the sealing head 8 and the skirt-like member 11 are arranged, in position in the apparatus. A cutter (not shown) which is provided behind the sealing head 8 cuts a long sheet 14 to produce a square-like base 3. Such a square-like base 3 is set on the die 9 over the top opening of the container body 1. The operation of the preliminary head 6, the pouring nozzle 7, the sealing head 8 and the pressing member 11 has been already described. The outline of the free edge of the cover in FIG. 16 differs from that in FIG. 1.

Figure 17:
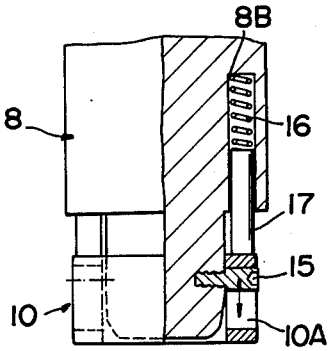
FIG. 17 is a sectional view indicating the details of the head and the ring.

FIG. 17 illustrates the details of the sealing head 8 and the ring 10. The ring 10 has slots 10A. A pin 15 fixed to the head 8 is inserted through each slot 10 so that the pin may be moved within the slot 10 when the ring 10 is moved upwardly by the edge of the cover 3 supported by the die 9. The head 8 has vertical holes 8B within each of which a compressed spring 16 is provided so as to depress a rod 17 against the ring 10.

Figure 18:
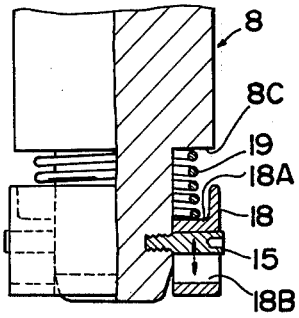
FIG. 18 is a sectional view illustrating another embodiment of a ring.

FIG. 18 shows another embodiment of a ring 18. In this embodiment, a relatively big compressed spring 19 is provided between a seat 8C of the head 8 and a seat 18A of the ring 18. The ring 18 has slots 18B through each of which the pin 15 fixed to the head 8 is movably provided.

Figure 19:
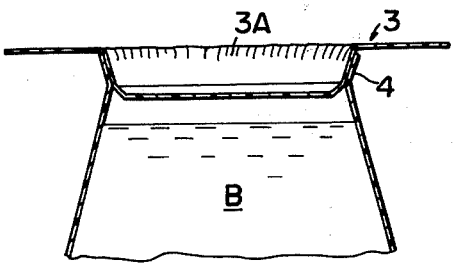
FIG. 19 is an enlarged view in section of a sealing condition the container body with the cover.

FIG. 19 illustrates in detail a sealing condition of the container body 1 with the cover 3 according to an embodiment of the present invention. The cover 3 is depressed by the head having at its bottom portion double tapers so that the depressed portion 3A correspond to the double tapers of the head. The first taper of the depressed portion of the cover is bonded to the inner surface of the widened portion of the container body 1.

The second taper of the depressed portion of the cover extends slightly into the body 1.

Figure 20:
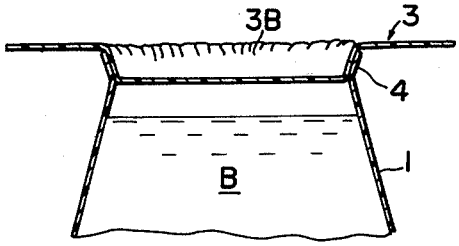
FIG. 20 is an enlarged view in section of another sealing condition.

FIG. 20 illustrates another sealing condition. In this embodiment, the head having at its bottom portion a single taper depresses the cover onto the inner face of the body so that the depressed portion 3B of the cover may have a single taper. The depressed portion of the cover is accurately bonded to the widened portion 4 of the body 1 without any extension of the cover into the body.

Figure 21:
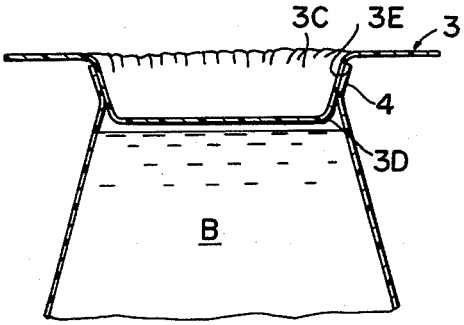
FIG. 21 is an enlarged view in section of still another sealing condition.

FIG. 21 illustrates still another embodiment of the sealing. In this embodiment, a depressed portion 3C of the cover 3 has a roundish corner 3D contiguous to a tapered portion 3E corresponding to the lower portion of the sealing head (not shown). Also, the cover 3 is deeply depressed into the end opening of the body 1 as compared with the embodiments as shown in FIGS. 19 and 20. In case of deep depressing, cracks and wrinkles are apt to occur at the top end of the body 1 made of paper material and the sealed portion of the cover 3, respectively, which will result in leakage therethrough. Especially, when the periphery of the cover is not held by the ring 10 and the die 9 in sealing, such wrinkles are apt to occur in depth in a region where the cover is sealed to the body.

According to the present invention, a sealed container may provide a perfect air and/or liquid tightness. As a result, the liquid or others contained in the container may be kept in a proper condition for a long time so as to prevent it from changing in quality. In addition, a size of the marginal free edge of the cover extending beyond the top end of the container body can be freely selected.

While preferred embodiments of the present invention have been described using specific terms, such description is for illustrative purposes only, and it is to be understood that changes and variations may be made without departing from the spirit or scope of the following claims.

What is claimed is:

1. A sealed container comprising:

a hollow truncated cone shaped body made of paper sheet material having air tightness, the top end of said body being smaller in size than the bottom and thereof, said smaller top end having an opening defined by the upper marginal edge portion of said sheet material which extends upwardly and outwardly;

means for closing said bottom end of said body; and a cover means made of sheet material being adhered to the inner surface of said marginal edge portion so as to make said container air-tight.

2. The sealed container as defined in claim 1 wherein said cover means has a depressed portion, a side wall of which is bonded to the inner surface of said upper marginal edge portion.

3. The sealed container as defined in claim 1 wherein said cover has a depressed portion including a tapered wall which is bonded to the inner surface of said widened edge of said top end of said body.

4. The sealed container as defined in claim 1 wherein said cover is of a disk-shape.

5. The sealed container as defined in claim 1 wherein said cover is of square or rectangle shape.

6. The sealed container as defined in claim 1 wherein said free edge of said cover is turned down along the outer surface of said body.

7. The sealed container as defined in claim 1 wherein said cover is made of polyester sheet coated with polyethylene.

8. The sealed container as defined in claim 1 wherein said cover is made of paper coated with polyethylene.

9. The sealed container as defined in claim 1 wherein the sheet material of said cover is made by laminating or coating polyethylene on one surface of an aluminum foil.

10. The sealed container as defined in claim 1 wherein said cover is made of an aluminum foil coated on its one surface with heat-sensitive and/or pressure sensitive material.

11. A sealed container comprising:

a hollow truncated cone shape body having at its smaller-size top end an opening surrounded by a marginal edge thereof, said body being made of sheet material including a paper and a polyethylene coating on the inner surface of said paper, said marginal edge of said body being widened so as to form a reverse-tapered small inner surface at the top end of said body;

means for closing the bottom end of said body; and a cover made of sheet material including an aluminum foil and a thermoplastic resin coating coated on the under surface of said foil, said cover having an annular portion which is bonded to said reverse-tapered inner surface of said body thereby to make said body air-tight and form a free edge at the periphery of said cover beyond said top end of said body.

12. The sealed container as defined in claim 11 wherein said cover includes a depressed portion the outer side wall of which is bonded to said inner surface of said body.

13. The sealed container as defined in claim 11 wherein said cover has a depressed portion having a tapered wall where said cover is bonded to said body.

14. A sealed container comprising:

(a) a container body means made of paper sheet material which is impermeable to air and liquid, said container body means having a lower body part formed from a first truncated cone with its larger diameter at the bottom of said container body means and a relatively smaller diameter at the top of said first truncated cone, an upper body part integral with the top of said first truncated cone, said upper body part formed from a second truncated cone with its larger diameter at the top of said container body means and the relatively smaller diameter of said second truncated cone being the same as said diameter at the top of said first truncated cone;

(b) a cover means for closing the top of said container body means, said cover means being made of a sheet material which is impermeable to air and liquid and being in the form of a third truncated cone which is disposed within said upper body part of said container body means so that the inner conical surface of said second truncated cone is contiguous to the outer conical surface of said third truncated cone;

(c) attaching means impermeable to air and liquid for attaching said contiguous inner and outer conical surfaces; and (d) a closure means impermeable to air and liquid attached to and closing the bottom of said container body means.

15. The invention of claim 14, wherein said cover means has a manually graspable marginal edge portion which extends beyond the top of said container body means, and said cover means is sufficiently strong relative to said attaching means that said cover means can be manually removed from said container body means to facilitate opening of said sealed container.

16. The invention of claim 14, wherein said paper sheet material of said container body means has a polyethylene coating, said sheet material of said cover means has a metal foil, and said attaching means includes a thermoplastic resin coating on said metal foil.

* * * * *